United States Patent [19]

Knappenberger

[11] 4,261,630

[45] Apr. 14, 1981

[54] HYBRID RF TERMINATION AND CONNECTOR SYSTEM

[75] Inventor: Thomas A. Knappenberger, Scottsdale, Ariz.

[73] Assignee: Motorola, Inc., Schaumburg, Ill.

[21] Appl. No.: 49,761

[22] Filed: Jun. 18, 1979

Related U.S. Application Data

[63] Continuation of Ser. No. 885,713, Mar. 13, 1978, abandoned.

[51] Int. Cl.[3] ..... H01R 17/04

[52] U.S. Cl. ..... 339/31 R; 339/177 R

[58] Field of Search ..... 339/31 R, 31 M, 31 T, 339/177 R, 177 E, 32 R, 32 M, 33; 174/87

[56] References Cited

U.S. PATENT DOCUMENTS

| | | | |
|---|---|---|---|
| 2,383,109 | 8/1945 | Conlan | 339/177 R |
| 3,024,438 | 3/1962 | Trush | 339/31 T |
| 3,047,828 | 7/1962 | Gregson et al. | 339/177 R |
| 3,750,090 | 7/1973 | Teman | 339/177 R |
| 4,049,902 | 9/1977 | de Ronde | 339/177 R |

*Primary Examiner*—Neil Abrams

*Attorney, Agent, or Firm*—Eugene A. Parsons

[57] ABSTRACT

A tubular body with an inner conductor coaxially mounted therein, one end being adapted for connection to a circuit or the like and the opposite end of the inner conductor being bifurcated for receiving an end of an external conductor in fixed engagement therewith in a first mode and for receiving a mating test connector in frictional sliding engagement therewith in a second mode. The tubular body defining an opening for receiving the external conductor therethrough and the end thereof being sealable to provide an electromagnetic shield around the connection of the center conductor and the external conductor.

9 Claims, 4 Drawing Figures

HYBRID RF TERMINATION AND CONNECTOR SYSTEM

This is a continuation of application Ser. No. 885,713, filed Mar. 13, 1978, now abandoned.

BACKGROUND OF THE INVENTION

In many types of electronic apparatus, and especially for rugged environment aircraft and space craft applications, it is desirable to provide test connectors so that mating connectors can be temporarily attached thereto for testing of the circuits prior to final use. Also, because of the type of use to which the apparatus is being applied, it is desirable to hardwire connections prior to the final use or final flight. Because of the requirements for testing prior to final flight and hardwired connections at the time of the final flight, it is desirable to incorporate a system wherein the testing can be done with temporary mating connectors and hardwired connections can then be substituted for the test connectors. This must be accomplished while minimizing the size and weight of the system.

SUMMARY OF THE INVENTION

The present invention pertains to a hybrid RF termination and connector system including an elongated tubular body with an elongated inner conductor coaxially mounted therein, one end of which is adapted to be connected to electronic circuits and the like and the other end of which has an opening therein for receiving one end of an external conductor in fixed engagement therewith in one mode of operation and the same end cooperating with the associated end of the body for receiving a mating connector in frictional sliding engagement therewith in a second mode of operation, the system further including means for sealing the end of the body in the first mode of operation to form an electromagnetic shield around the junction of the inner conductor and the external conductor and an external opening through the shield to allow the insertion of the external conductor.

It is an object of the present invention to provide a new and improved hybrid RF termination and connector system.

It is a further object of the present invention to provide a hybrid RF termination and connector system with which mating connectors can be used for testing purposes and hardwired connections can be substituted therefore to enhance reliability while minimizing size and weight.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
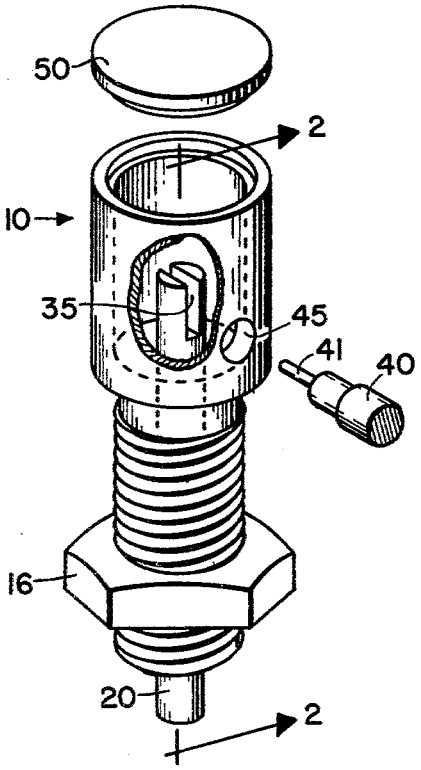
FIG. 1 is an exploded view in perspective of a hybrid RF termination and connector system embodying the present invention.
Figure 2:
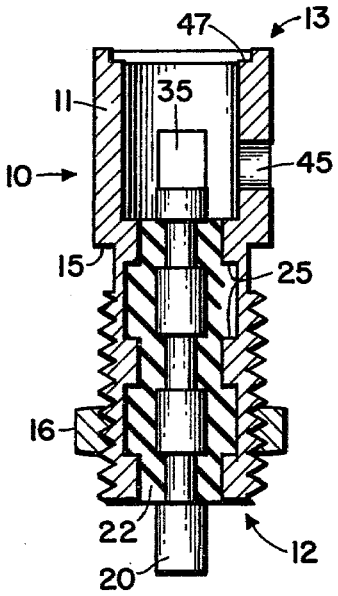
FIG. 2 is a sectional view as seen from the line 2—2 in FIG. 1.

Referring specifically to FIGS. 1 and 2, the numeral 10 generally designates a hybrid RF termination and connector system including a tubular body 11 with ends 12 and 13. The body 11 is threaded from the end 12 approximately midway therealong and the remainder of the body has a larger diameter to form a shoulder 15. A nut 16 is threadedly engaged on the body 11 and cooperates with the shoulder 15 for mounting the system 10 in an opening defined by the bulkhead of a chassis or the like. The system may also be threadedly engaged in a threaded opening in a bulkhead, or a second nut may be threadedly engaged with the threaded portion of the body 10 to affix a bulkhead between the nut 16 and the second nut (not shown). The system 10 is mounted in the bulkhead of a chassis in FIG. 4.

An elongated inner conductor 20 is coaxially mounted within the body 11 by means of dielectric material 22. The dielectric material 22 is constructed to extend from the end 12 of the body 11 midway along the body so that a portion of the opening through the body 11 remains unfilled. The inner surface, or the surface of the opening through the body 11, has a plurality of radially inwardly extending shoulders 25 formed therein. The diameter of the dielectric material 22 varies in accordance with the diameter of the opening through the body 11 so that the dielectric material 22 is fixedly engaged in the body 11 to prevent relative axial movement therebetween. In a similar fashion, the diameter of the inner conductor 20 is varied, in correspondence with the variations in the diameter of the dielectric 22 to maintain the impedance of the coaxial section substantially constant. These radially inwardly extending steps or shoulders in the inner conductor 20 also cooperate with the dielectric material 22 to prevent relative axial movements between the inner conductor 20, the dielectric 22, or the body 11.

In the present embodiment, one end of the inner conductor 20 extends outwardly beyond the end 12 of the body 11 so that external connections can easily be made thereto. For example, in FIG. 4 one connecting pad 30 of a printed circuit board 31 is connected to the inner conductor by means of an external conductor 32. While the inner conductor 20 extends outwardly beyond the end 12 of the body 11 in this embodiment, it should be understood that the end 12 of body 11 and the inner conductor 20 may cooperate in many other ways to provide means for connecting the RF system to circuits, external conductors and the like.

The opposite end of the inner conductor 20 has an opening therein, in this embodiment bifurcation 35, for receiving an end of an external conductor, e.g., cable 40 with inner conductor 41, in engagement therewith. An opening 45 is formed in the side of the body 11 in general axial alignment with the bifurcation 35 so that the cable 40 can be inserted therethrough and fixed thereto and the conductor 41 can be fixedly engaged in the bifurcation 35, by some means such as soldering or the like.

The bifurcation 35 in the end of the inner conductor 20 is generally centrally positioned within the unfilled area of body 11. The open end 13 of the body 11 is spaced from the bifurcation 35 and has an indentation 47 therein for receiving a cap 50. With the external conductor 41 fixedly engaged in the bifurcation 35 the cap 50 can be fixedly engaged in the indentation 47 of the end 13 so that the body 11 completely encloses the connection and forms a fixed impedance and an electromagnetic shield therearound. Also, by constructing the body 11, the inner conductor 20, the openings (bifurcation) 35 and 45 and the cap 50 with the correct spacing throughout the voltage standing wave ratio of the connector can be maintained within the range of 1.05:1 to 1.5:1 within a range of frequencies of at least DC to 10 GHz. It should be understood that the external cable 40 and the opening 45 might be positioned differently, but the embodiment illustrated is believed to be the simpliest and most efficient for completing the hardwiring of the external cable 40.

Figure 3:
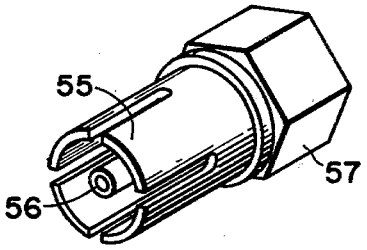
FIG. 3 is a perspective view of one type of hybrid mating test connector which may be utilized with the system of FIG. 1.

FIG. 3 illustrates a hybrid mating test connector having an external tubular metal portion 55 and an internal tubular metal portion 56. Both tubular portions 55 and 56 are slotted to provide a spring-like effect for frictional sliding engagement with the body 11 and inner conductor 20 of the system 10. The test connector of FIG. 3 has a coupling nut 57 forming a portion thereof for connecting the device to a cable or the like in a manner well known to those skilled in the art. FIG. 3 simply illustrates one type of mating test connector and it should be understood that many other types might be devised, e.g., a connector that threadedly engages the end 13.

Figure 4:
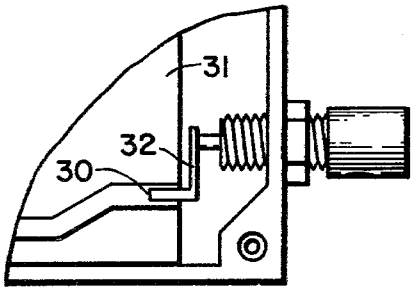
FIG. 4 is a plan view of a section of printed circuit board and chassis having the system of FIG. 1 operatively connected thereto.

Thus, the hybrid RF system is connected, for example, as illustrated in FIG. 4 and the circuitry associated therewith is tested by external circuitry which is connected thereto through the mating test connector described, or some equally adaptable test connector. When the testing is completed and the associated circuitry is ready for final flight or other final utilization, the mating test connector is removed and cable 40 is inserted in the opening 45 with the external conductor 41 positioned in the bifurcation 35. Fixed connections are made therebetween and the cap 50 is fixedly engaged with the body 11. The circuitry is now hardwired for operation in the intended manner.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. A hybrid RF termination and connector system comprising:

a fixed connector adapted to be hardwired to an electronic circuit including (a) an elongated tubular body defining an opening extending axially therethrough with first and second ends;

(b) an elongated inner conductor mounted generally coaxially within the opening of said body, one end of said inner conductor cooperating with the associated first end of said body to provide means for connecting the RF system to the electronic circuit;

(c) the other end of said inner conductor defining an opening therein for receiving an end of an external conductor therein in fixed engagement in one mode of operation and cooperating with the associated second end of said body for receiving a mating connector in engagement therewith in a second mode of operation;

(d) sealing means engageable with the second end of said body in the one mode of operation for substantially enclosing the other end of said inner conductor and forming an electromagnetic shield therearound;

(e) an opening in said system adjacent the second end of said body for allowing the insertion therethrough of the end of the external conductor; and (f) said system being constructed so that it operates in the second mode to provide a fixed impedance in the system; and a mating connector constructed to be engaged with the other end of said inner conductor and the associated second end of said body of said fixed connector in the second mode of operation, said mating connector having means for fixedly connecting an external test lead thereto for temporary connection to the electronic circuit through the connector system in the second mode of operation.

2. A hybrid RF termination and connector system as claimed in claim 1 wherein the opening in the inner conductor and the opening in the system are axially aligned and generally transverse to the inner conductor.

3. A hybrid RF termination and connector system as claimed in claim 1 wherein the other end of the inner conductor is bifurcated to form the opening therein.

4. A hybrid RF termination and connector system as claimed in claim 1 wherein the sealing means includes a cap formed to engage the second end of said body.

5. A hybrid RF termination and connector system as claimed in claim 1 wherein the tubular body, the inner conductor, the cap and the openings are constructed to provide a voltage standing wave ratio in the range of approximately 1.05:1 to 1.5:1 for a range of frequencies from approximately DC to 10 GHz.

6. A hybrid RF termination and connector system as claimed in claim 1 wherein the tubular body has external means thereon for mounting the system in a bulkhead and the like.

7. A hybrid RF termination and connector system as claimed in claim 1 wherein the inner conductor is fixedly mounted coaxially within the tubular body by means of dielectric material fixedly positioned therebetween.

8. A hybrid RF termination and connector system as claimed in claim 7 wherein the inner conductor, the surface of the axial opening through the tubular body and the dielectric material are formed with mating irregular surfaces to prevent relative axial movements therebetween.

9. A hybrid RF termination and connector system as claimed in claim 1 wherein the one end of the inner conductor extends outwardly beyond the first end of said body for fixedly engaging an external conductor thereto.

* * * * *